United States Patent [19]

Yoshiro

[11] Patent Number: 4,698,927

[45] Date of Patent: Oct. 13, 1987

[54] BADGE INDICATIVE OF FACE EXPRESSIONS

[76] Inventor: Takashima Yoshiro, Kanko Bldg. 5-13 1-chome, Taito-ku Komagata, Japan

[21] Appl. No.: 832,081

[22] Filed: Feb. 24, 1986

[30] Foreign Application Priority Data

Jul. 17, 1985 [JP] Japan ..... 60-109287[U]

[51] Int. Cl.[4] ..... A44C 3/00

[52] U.S. Cl. ..... 40/1.6; 40/1.5; 446/337; 446/339

[58] Field of Search ..... 40/1.6, 1.5; 434/326, 434/94, 365, 371, 396, 408, 433; 446/321, 337, 338, 339, 340

[56] References Cited

U.S. PATENT DOCUMENTS

| | | | |
|---|---|---|---|
| 276,586 | 5/1883 | Holden | 40/1.6 X |
| 290,827 | 12/1883 | Wiehl | 40/1.6 X |
| 837,216 | 11/1906 | Gilbert | 40/1.6 X |
| 3,014,309 | 12/1961 | Carroll | 446/338 |
| 3,180,054 | 4/1965 | Knott | 446/337 |
| 3,440,349 | 4/1969 | Gibbs | 446/337 |
| 3,839,821 | 10/1974 | Forsman | 40/1.5 X |
| 4,215,388 | 7/1980 | Reimann | 40/1.5 X |
| 4,402,157 | 9/1983 | White et al. | 446/339 |

*Primary Examiner*—Gene Mancene
*Assistant Examiner*—J. Hakomaki
*Attorney, Agent, or Firm*—Holman & Stern

[57] ABSTRACT

A badge having a design of a face in which members corresponding to eyebrows, eyes and a mouth are movably mounted on the front side of a body of the badge to indicate facial expressions such as, for example, a smile or a frown. Engaging members for allowing relative movement in the directions of the members corresponding to the eyebrows, the eyes and the mouth project from the back surface side of the body of the badge, and an operating plate having slots engaged with the engaging members is movably mounted on the body, thereby controlling the movements of the eyebrow, the eye and the mouth members according to the shape of the slots.

12 Claims, 8 Drawing Figures

BADGE INDICATIVE OF FACE EXPRESSIONS

BACKGROUND OF THE INVENTION

1. Field of the Invention

This invention relates to a badge having functions capable of indicating a variety of facial expressions.

2. Description of the Prior Art

There are conventional badges of various types which optically alter the contents according to the observing angle, but the badges are not adequate for intentionally indicating a special face expression. In order to indicate the intended face expression, it is necessary to operate the eyes and the mouth, but a badge having such a structure is not known today.

BRIEF SUMMARY OF THE INVENTION

An object of this invention is to provide a badge indicative of facial expressions evident in variations in the badge which can simply and reliably be made by changing members corresponding to eyebrows, eyes and a mouth in a predetermined mutual relationship.

The above object can be achieved by providing a badge indicative of facial expressions which comprises members movably supported in openings formed in a badge body for holding eyebrow members, eye members and a mouth member, engaging pins projected at the back surface side of the body for supporting the members, an operating plate rotatably mounted on the back of the body and having cam slots for varying the positions of the engaging pins by maintaining the mutual relationship while varying the positions and the states of eyebrow members, eye members and mouth holding member, the pins engaging with the cam slots.

The badge indicative of facial expressions of this invention has pins projecting from support members for supporting eyebrow members, eye members and mouth holding members to the badge body and the pins engage with cam slots of an operating plate. Thus, the eyebrow members, the eye members and the mouth holding member are altered by turning the operating plate so that the state of the variation accords with the shape of the cam slots. Therefore, the cam slots perform a function of a program for determining the variation in the members. The manner of varying the facial expression is altered by varying the control plate, and the variation in the integral facial expression can be performed as a whole by the single control plate.

According to this invention as described above, the state (ordinary face expression) of FIG. 4 can be readily altered to an angry expression A as shown in FIGS. 5, 6 or a face expression B shown in FIGS. 7, 8 by the rotating operation of the operating control plate, and since the members of eyebrows, the eyes and the mouth move in accordance with the state of the cam slot formed in the operating plate while maintaining the mutual relation among the members. Thus, the variation in the face expression can be remarkably natural and smooth, and not only the special face expression such as angry expression A but also the intermediate face expression can be freely provided.

BRIEF DESCRIPTION OF THE DRAWINGS

The invention will now be described in detail with reference to the accompanying drawings wherein.

DESCRIPTION OF THE PREFERRED EMBODIMENTS

Figure 1:
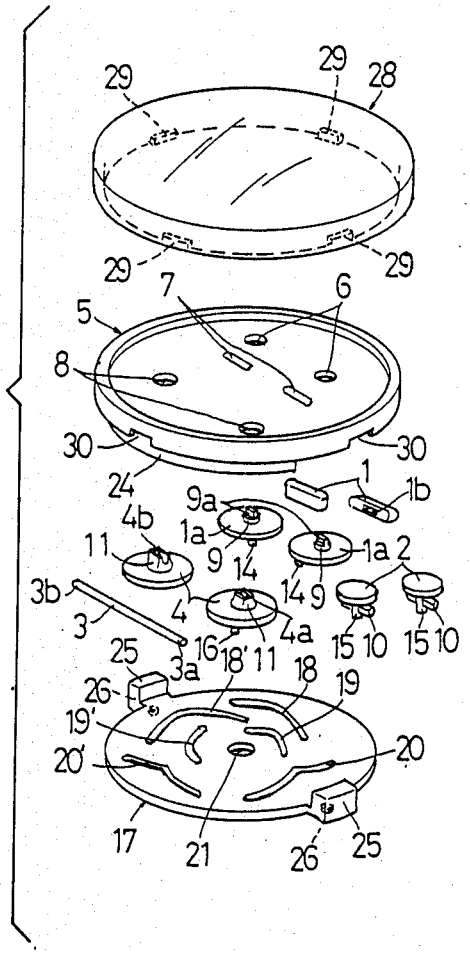
FIG. 1 is an exploded perspective view of an embodiment of a badge indicative of facial expressions according to this invention.

Reference numerals 1 and 1 designate a pair of eyebrow members made of short rod-shaped materials, numerals 1*a* and 1*a* depict a pair of eyebrow mounting plates formed in a circular shape, numerals 2 and 2 indicate a pair of eye members formed longitudinally in oblong shape, numeral 3 illustrates a mouth member made of a flexible rod-shaped material, numerals 4 and 4 illustrate a pair of mouth holding members formed in a circular shape for holding both ends of the member 3, the members 4 respectively have opposed long slots 4*a*, 4*b*, and one end 3*a* of the member 3 is fixedly fastened to slot 4*a* of the long slots, but end 3*b* is slidably held in slot 4*b*.

Figure 2:
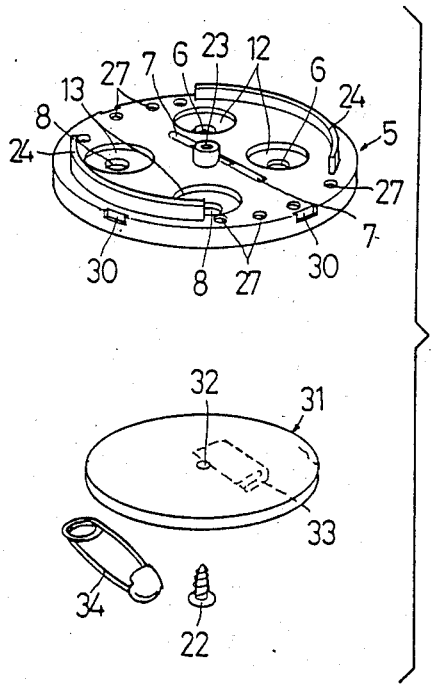
FIG. 2 is a perspective view of the back surface side of a badge body.
Figure 4:
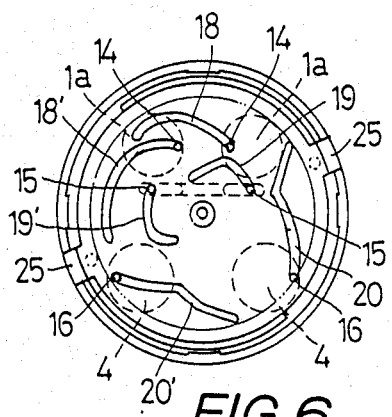
FIG. 4 is a back surface elevational view showing the relationship between the pin and the cam slot of a certain face expression.
Figure 3:
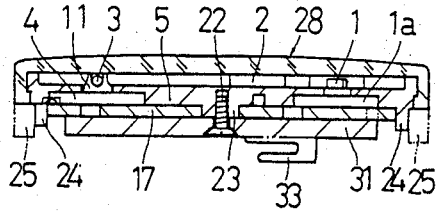
FIG. 3 is a cross-sectional view of the badge taken along line III—III of FIG. 5.
Figure 6:
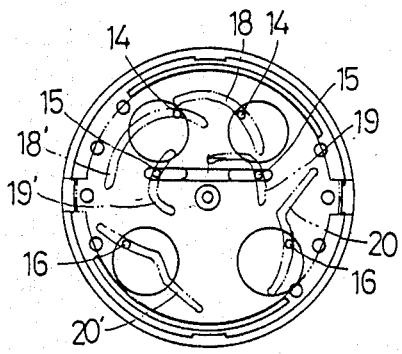
FIG. 6 is a back elevational view similar to FIG. 4 of the case.
Figure 5:
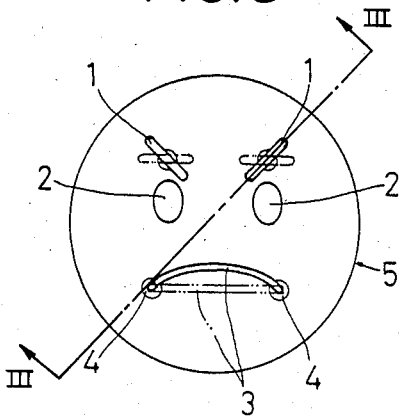
FIG. 5 is a front elevational view of a face expression A.
Figure 8:
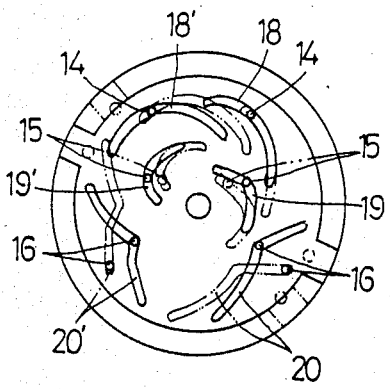
FIG. 8 is a back view of the case similar to FIG. 4.
Figure 7:
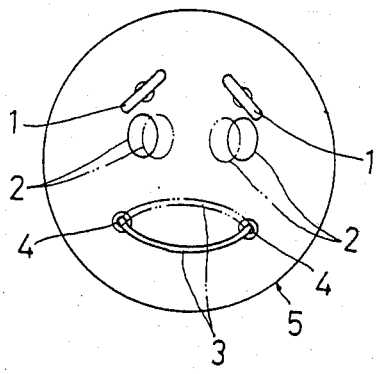
FIG. 7 is a front elevational view of the surface B.

Reference numeral 5 designates a badge body to become a face, numerals 5 and 6 depict a pair of openings for supporting the eyebrow members formed thereat, numerals 7 and 7 indicate a pair of long openings for supporting the eye members, and numerals 8 and 8 illustrate a pair of openings for supporting the mouth holding member. The members 1 are fastened rotatably by engaging the end 9*a* of the shaft 9 with the slot 1*b* from the front after inserting the shaft 9 into the openings 6. Each eye member 2 is mounted on the badge body 5 by inserting a shaft 15 with retainer 10 thereon into one of the long openings 7 from the front, and the mouth holding member 4 is fastened at one end of the mouth member 3 to the badge body 5 from the front after inserting a shaft 11 into the opening 8. In this case, the circular eyebrow mounting plates 1*a*, 1*a* and the mouth holding members 4, 4 are respectively engaged with circular recesses 12, 12 and 13, 13, respectively formed on the back surface of the badge body 5 (FIG. 2).

Reference numerals 14 and 14 designate eyebrow control pins projected from the back of the circular eyebrow mounting plate 1*a*, the outer ends of shafts 15 and 15 are eye control pins projected from the backs of the eye members 2 and 2, numerals 16 and 16 indicate mouth control pins projected from the backs of the circular mouth holding members 4, 4, which are all displaced eccentrically from the axes, thereby providing an amplification or a variety in the movements of the members. Numeral 17 indicates a circular operating plate, numerals 18, 18'; 19, 19'; 20, 20' respectively illustrate cam slots to be engaged with control pins 14, 15, 16 of the eyebrow, eye and mouth members, numeral 21 designates a through hole for a stopper shaft 22, numeral 23 depicts a central opening of the body 5 engaged with the shaft 22, and numerals 24, 24 indicate a pair of arcuate ribs for defining the moving range of the engaging pieces 25, 25 projecting from the edges of the plate 17. A projection 26 and engaging recesses 27 therefore are respectively formed on the plate 17 and body 5 to perform click stops in the rotating range.

Reference numeral 28 designates a transparent cover for covering the body 5, numeral 29 depicts an engaging pawl formed on the inner periphery of the cover, numeral 30 indicates an engaging slot formed in the body 5, numeral 31 illustrates a back plate, numeral 32 is a screw inserting opening formed at the center of the plate 31, and numeral 33 shows a hook for a mounting pin 34 formed on the back plate 31.

The cam slots 18 to 20' to be engaged with the pins 14, 15, 16 of the members 1, 2, 3, respectively, are formed so that when operated as shown in the exemplified embodiment in the drawings the spirally shaped slots 18, 18' of the eyebrow members 1 rotate the pair of eyebrow members 1 and 1 the rotation of plate 17 in one direction to move the pin 14 of the member 1 from the exterior to the interior, the slots 19, 19' are formed so that the eye members 2, 2 approach or separate by the same rotation, and the slots 20, 20' are formed in the shape to rotate the mouth holding members 4, 4. Further, the badge having further various face expressions can be formed by designing and altering the construction of the shapes of the slots 18 to 20' and engaging structure with the pins 14, 15, 16, and the states of the members 1, 2 and 3.

I claim:

1. A decorative changeable image badge comprising:
- a badge body having front and back sides;
- first holes in said badge body;
- eyebrow members rotatably supported in said first holes on said front side of said badge body and having front and back sides;
- an eyebrow control pin projecting from said back side of each eyebrow member;
- second elongated holes in said badge body;
- eye members slidably mounted in said second holes on said front side of said badge body and having front and back sides;
- an eye control pin projecting from said back side of each eye member;
- third holes in said badge body;
- mouthpiece holding members rotatably mounted in said third holes and having front and back sides
- mouth control pin means projecting from said back sides of said mouthpiece holding members;
- an elongated flexible mouthpiece member having ends connected to said mouthpiece holding members;
- an operating plate rotatably mounted on said back side of said badge body; and
- a plurality of cam slots in said operating plate operatively receiving said control pins and pin means and having configurations so that reciprocating rotation of said operating plate causes said control pins and pin means to slide in said cam slots and simultaneously move said eyebrow members, eye members and mouthpiece holding members relatively to each other and said badge body to vary the expression of a face formed by said eyebrow members, eye members and mouthpiece member, the relative shape and position of said cam slots being predetermined for programming the variation of expression.

2. A decorative badge as claimed in claim 1 wherein:
- one of said ends of said flexible element is fixedly connected to one of said mouthpiece holding members and the other end of said flexible element is slidably connected to another of said mouthpiece holding members.

3. A decorative badge as claimed in claim 1 wherein:
- at least some of said cam slots are curved.

4. A decorative badge as claimed in claim 2 wherein:
- at least some of said cam slots are curved.

5. A decorative badge as claimed in claim 1 wherein each eyebrow member comprises:
- an eyebrow mounting plate having front and back sides;
- a shaft projecting from said front side of said mounting plate rotatably engaging through one of said first holes;
- an eyebrow control pin projecting from said back side of said mounting plate;
- eyebrow element engaging means on the outer end of said shaft;
- an eyebrow element; and
- attaching means on said eyebrow element for attaching said eyebrow element to said engaging means.

6. A decorative badge as claimed in claim 2 wherein each eyebrow member comprises:
- an eyebrow mounting plate having front and back sides;
- a shaft projecting from said front side of said mounting plate rotatably engaging through one of said first holes;
- an eyebrow control pin projecting from said back side of said mounting plate;
- eyebrow element engaging means on the outer end of said shaft;
- an eyebrow element; and
- attaching means on said eyebrow element for attaching said eyebrow element to said engaging means.

7. A decorative badge as claimed in claim 1 wherein each eye member comprises:
- an eyepiece having front and back sides; and
- a shaft projecting from said back side of said eyepiece extending through one of said second holes, and having an outer end comprising said eye control pin.

8. A decorative badge as claimed in claim 2 wherein each eye member comprises:
- an eyepiece having front and back sides; and
- a shaft projecting from said back side of said eyepiece exending through one of said second holes, and having an outer end comprising said eye control pin.

9. A decorative badge as claimed in claim 6 wherein each eye member comprises:
- an eyepiece having front and back sides; and
- a shaft projecting from said back side of said eyepiece extending through one of said second holes, and having an outer end comprising said eye control pin.

10. A decorative badge as claimed in claim 16 wherein said operating plate comprises a circular disc, and further comprising:
- arcuate retaining ribs on said back side of said badge body for slidably engaging and retaining the periphery of said operating plate.

11. A decorative badge as claimed in claim 10 and further comprising:
- means on said operating plate for manually gripping and rotating said operating plate.

12. A decorative badge as claimed in claim 11 and further comprising:
- cooperating detent means on said circular disc and said badge body for releasably retaining said circular disc in a plurality of positions of rotation.

* * * * *